US011344474B2

(12) United States Patent
Asano et al.

(10) Patent No.: US 11,344,474 B2
(45) Date of Patent: May 31, 2022

(54) CONTAINER CONNECTOR AND CONNECTION EQUIPMENT

(71) Applicant: DAIWA CAN COMPANY, Tokyo (JP)

(72) Inventors: Toshihiro Asano, Sagamihara (JP); Toshio Iino, Sagamihara (JP); Mio Hattori, Sagamihara (JP); Naoyuki Takahashi, Sagamihara (JP); Naoki Sunaga, Sagamihara (JP)

(73) Assignee: Daiwa Can Company, Tokyo (JP)

( * ) Notice: Subject to any disclaimer, the term of this patent is extended or adjusted under 35 U.S.C. 154(b) by 172 days.

(21) Appl. No.: 16/776,569

(22) Filed: Jan. 30, 2020

(65) Prior Publication Data

US 2020/0163835 A1 May 28, 2020

Related U.S. Application Data

(63) Continuation of application No. PCT/JP2018/028432, filed on Jul. 30, 2018.

(30) Foreign Application Priority Data

Jul. 31, 2017 (JP) ..... JP2017-148413

(51) Int. Cl.
*A61J 1/20* (2006.01)

(52) U.S. Cl.
CPC ..... *A61J 1/2065* (2015.05); *A61J 1/2096* (2013.01); *A61J 1/201* (2015.05)

(58) Field of Classification Search
CPC ..... A61J 1/2065; A61J 1/2096; A61J 1/201
See application file for complete search history.

(56) References Cited

U.S. PATENT DOCUMENTS 5,279,576 A * 1/1994 Loo ..... A61J 1/2096 222/1
6,070,623 A 6/2000 Aneas
8,469,939 B2 6/2013 Fangrow, Jr.
9,731,083 B2 8/2017 Asano et al.
(Continued)

FOREIGN PATENT DOCUMENTS

CN 1237892 A 12/1999
CN 102481229 A 5/2012
(Continued)

OTHER PUBLICATIONS

Japanese Office Action dated Apr. 20, 2021 for Application No. 2017-148413 (with English translation) (7 pages).
(Continued)

*Primary Examiner* — Timothy P. Kelly
(74) *Attorney, Agent, or Firm* — Harness, Dickey & Pierce, P.L.C.

(57) ABSTRACT

Container connector includes a base in which a flow path is formed, an engagement section disposed on a circle set to the base, a guiding section disposed continuously with the engagement section, and having a guide surface formed as a curved surface to guide the container to the engagement section and facing a side of an axis of the circle, and an arm provided in the base, and movably supporting the guiding section in a direction toward the axis of the circle and a direction away from the axis.

4 Claims, 16 Drawing Sheets

(56) References Cited

U.S. PATENT DOCUMENTS

| | | | | |
|---|---|---|---|---|
| 2009/0216212 | A1* | 8/2009 | Fangrow, Jr. | A61J 1/2096 604/406 |
| 2010/0106129 | A1 | 4/2010 | Goeckner et al. | |
| 2010/0160889 | A1* | 6/2010 | Smith | A61J 1/2096 604/414 |
| 2012/0179129 | A1 | 7/2012 | Imai | |
| 2014/0261877 | A1 | 9/2014 | Ivosevic et al. | |
| 2014/0276649 | A1 | 9/2014 | Ivosevic et al. | |
| 2015/0265499 | A1 | 9/2015 | Takeuchi | |
| 2016/0008224 | A1 | 1/2016 | Rahimy et al. | |
| 2016/0058667 | A1 | 3/2016 | Kriheli | |
| 2018/0064605 | A1* | 3/2018 | Noguchi | A61M 39/14 |

FOREIGN PATENT DOCUMENTS

| | | | |
|---|---|---|---|
| CN | 203989302 | U | 12/2014 |
| CN | 204170096 | U | 2/2015 |
| EP | 3607928 | A1 | 2/2020 |
| JP | 2011512205 | A | 4/2011 |
| JP | 5509097 | B2 | 6/2014 |
| JP | 2015-211763 | A | 11/2015 |
| JP | 2016-512078 | A | 4/2016 |
| WO | WO2009105489 | A1 | 8/2009 |
| WO | 2014150674 | A2 | 9/2014 |
| WO | WO-2016/152801 | A1 | 9/2016 |
| WO | WO-2016152801 | A1 * | 9/2016 ..... A61J 1/20 |

OTHER PUBLICATIONS

International Search Report dated Sep. 4, 2018 for PCT/JP2018/028432 with English translation (3 pages).

Office Action for Singapore Application No. 11202000643Q dated Oct. 13, 2020 (with English translation) (6 pages).

European Search Report for Application No. 18842317.2 dated Mar. 26, 2021 (with English translation) (9 pages).

English Translation of International Preliminary Report on Patentability for PCT/JP2018/028432 dated Feb. 13, 2020 (8 pages).

Taiwanese Office Action for corresponding Application No. 107126509 dated Jul. 28, 2021 with English translation (10 Pages).

Chinese Office Action for corresponding Application No. 201880050391.4 dated Dec. 14, 2021 with English translation (24 Pages).

* cited by examiner

CONTAINER CONNECTOR AND CONNECTION EQUIPMENT

CROSS-REFERENCE TO RELATED APPLICATIONS

This is a Continuation Application of PCT Application NO PCT/JP2018/028432, filed on Jul. 30, 2018 and based upon and claiming the benefit of priority from prior Japanese Patent Application No. 2017-148413, filed Jul. 31, 2017, the entire contents all of which are incorporated herein by reference.

BACKGROUND OF THE INVENTION

1. Field of the Invention

Embodiments described herein relate to a container connector to be connected to a container, and connection equipment that connects a syringe to a container and forms a flow path between the container and the syringe.

2. Description of the Related Art

There is known connection equipment for use in collecting a chemical solution to a syringe from a container such as a vial that contains the chemical solution, such as an anti-cancer agent. The connection equipment has a container connector connected to the container and a syringe connector connected to the syringe. Each of the container connector and the syringe connector has a flow path through which the chemical solution can flow. When the container connector and the syringe connector are connected to each other, these flow paths are connected to each other, and the flow path is accordingly formed from the container to the syringe. Furthermore, when the syringe is operated, the chemical solution in the container flows through this flow path to move to the syringe.

The container connector is connected to the container when an engagement section engages with a neck or the like of the container, in a state where a needle of the container connector is stuck in a rubber plug provided in an opening of the container. As the engagement section, there is known an engagement section including two tabs and holding the neck of the container with protrusions formed on inner surfaces of the tabs. This type of technology is disclosed in, for example, Japanese Patent No. 5509097. The two tabs are moved in a direction away from each other to enlarge a distance therebetween.

The above described container connector including the engagement section holding the neck of the container by two tabs has the following problem. That is, in the container, such as a vial, a peripheral surface of the neck is typically formed as a curved surface. Consequently, a protrusion of each tab abuts on the neck at a point. The neck having the curved peripheral surface is held by the two tabs, thereby causing a problem that the container is unstable relative to the container connector.

Furthermore, to expand the tabs in accordance with the container, an operator needs to perform an operation of pulling two tabs upwardly with both hands. Consequently, in case of connecting the container connector to the container, the operator places the container on a workbench such as a desk, aligns a position of the container connector expanded with both the hands relative to the placed container, and narrows a distance between the two tabs so that the neck of the container is held by the two tabs. Consequently, there is a problem that operation steps are complicated.

BRIEF SUMMARY OF THE INVENTION

According to an aspect of embodiments, container connector includes a base in which a flow path is formed, an engagement section disposed on a circle set to the base, a guiding section disposed continuously with the engagement section, and having a guide surface formed as a curved surface to guide the container to the engagement section and facing a side of an axis of the circle, and an arm provided in the base, and movably supporting the guiding section in a direction toward the axis of the circle and a direction away from the axis.

BRIEF DESCRIPTION OF THE SEVERAL VIEWS OF THE DRAWINGS

The accompanying drawings, which are incorporated in and constitute a part of the specification, illustrate embodiments of the invention, and together with the general description given above and the detailed description of the embodiments given below, serve to explain the principles of the invention.

DETAILED DESCRIPTION OF THE INVENTION

A container connector 10 according to a first embodiment of the present invention will be described with reference to FIG. 1 to FIG. 10. The container connector 10 is configured to be connectable to a container 5.

Figure 1:
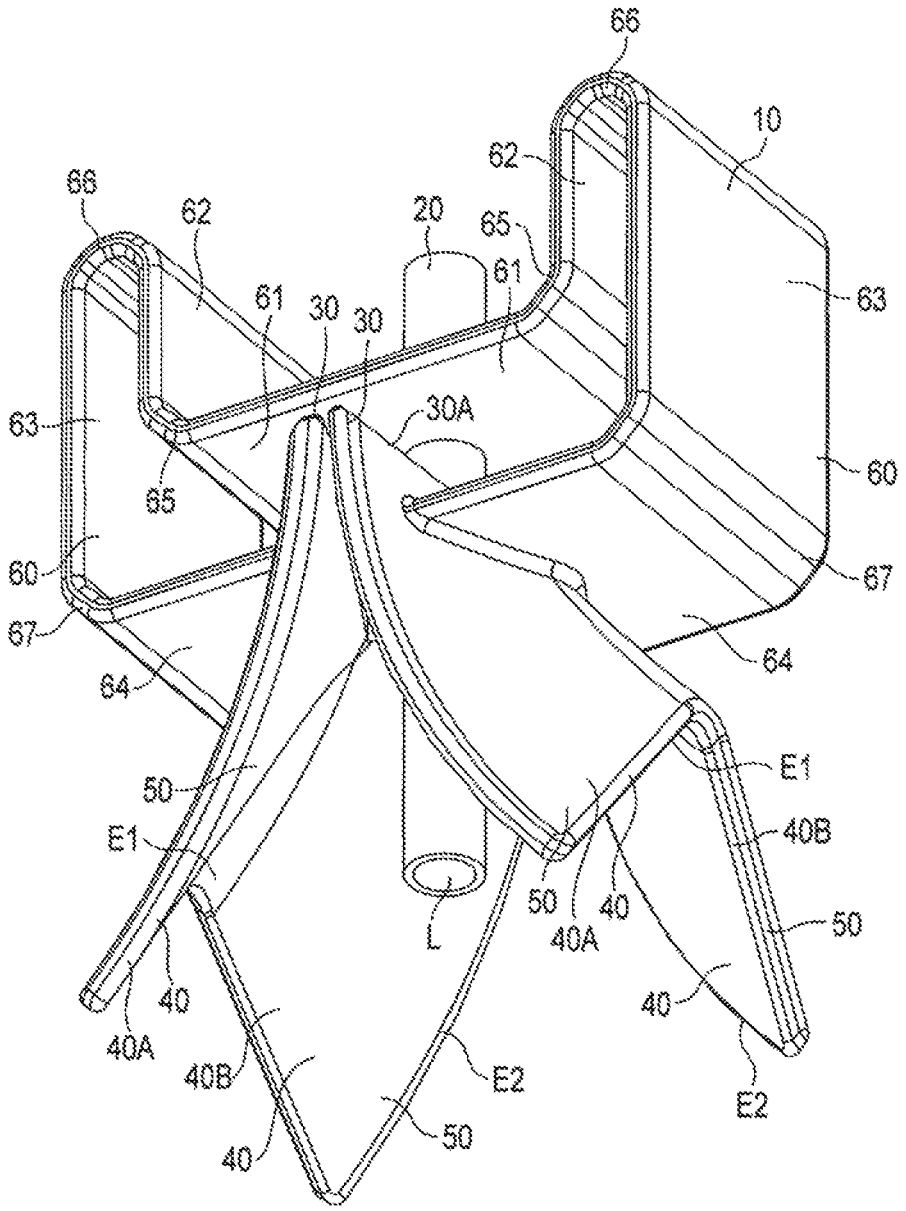
FIG. 1 is a perspective view showing a container connector according to a first embodiment of the present invention.
Figure 2:
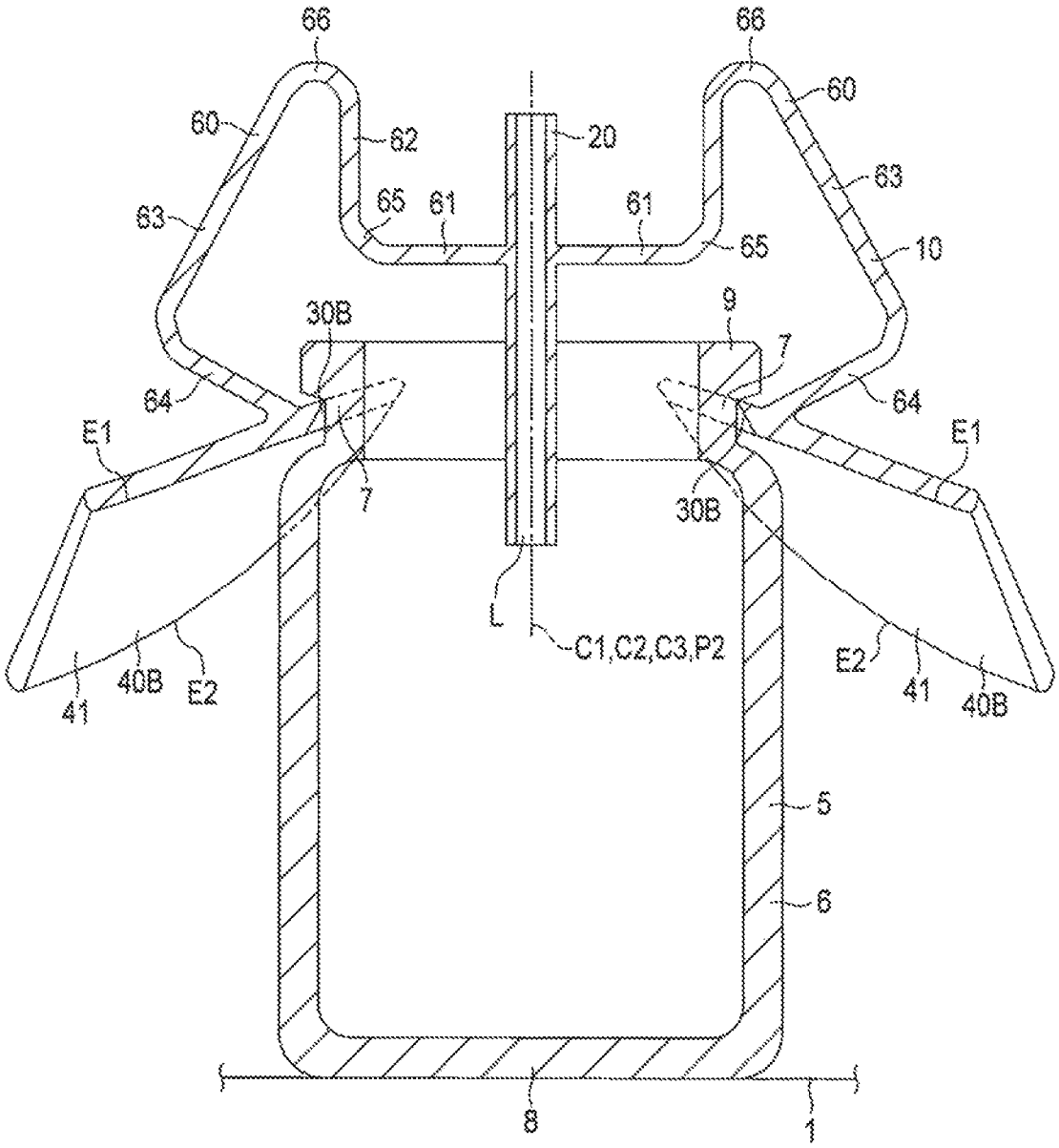
FIG. 2 is a cross-sectional view showing a state where the container connector is connected to a container.

FIG. 1 is a perspective view showing the container connector 10. FIG. 1 shows a state where the container connector 10 is seen from below. FIG. 2 is a cross-sectional view showing a state where the container connector 10 is connected to the container 5. FIG. 2 shows a state where the container connector 10 and the container 5 are cut along a cross section that passes along an axis C1 of a base 20 of the container connector 10 and is parallel to the axis C1.

Figure 3:
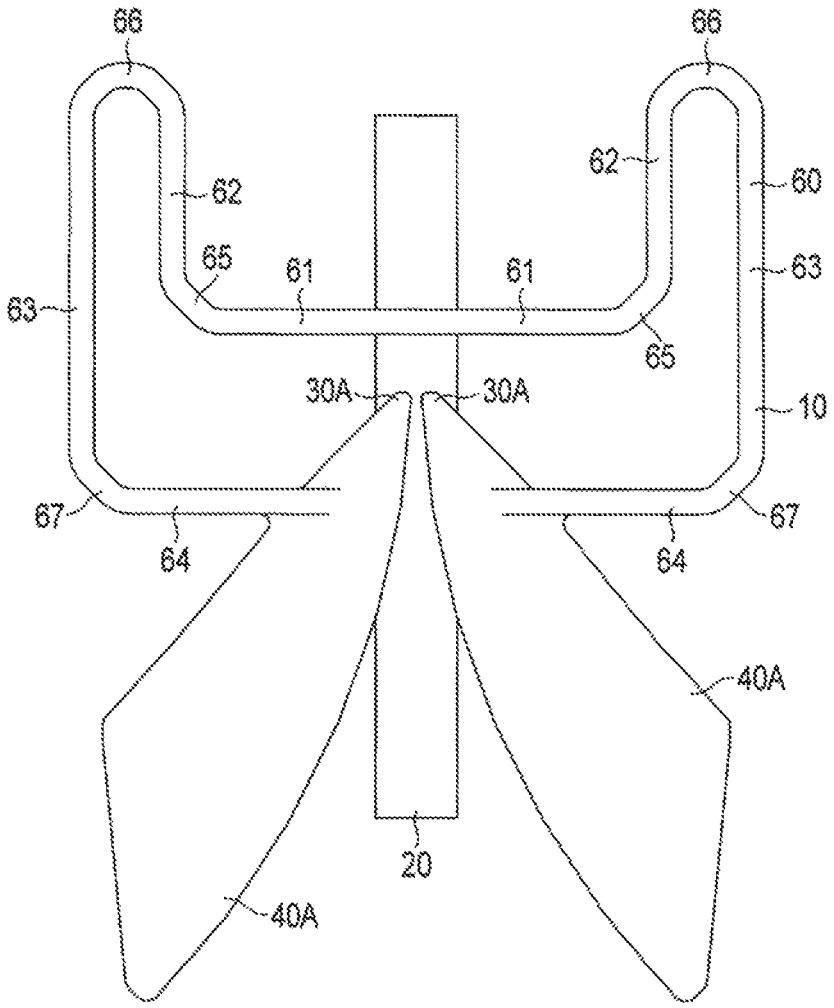
FIG. 3 is a side view showing the container connector.
Figure 4:
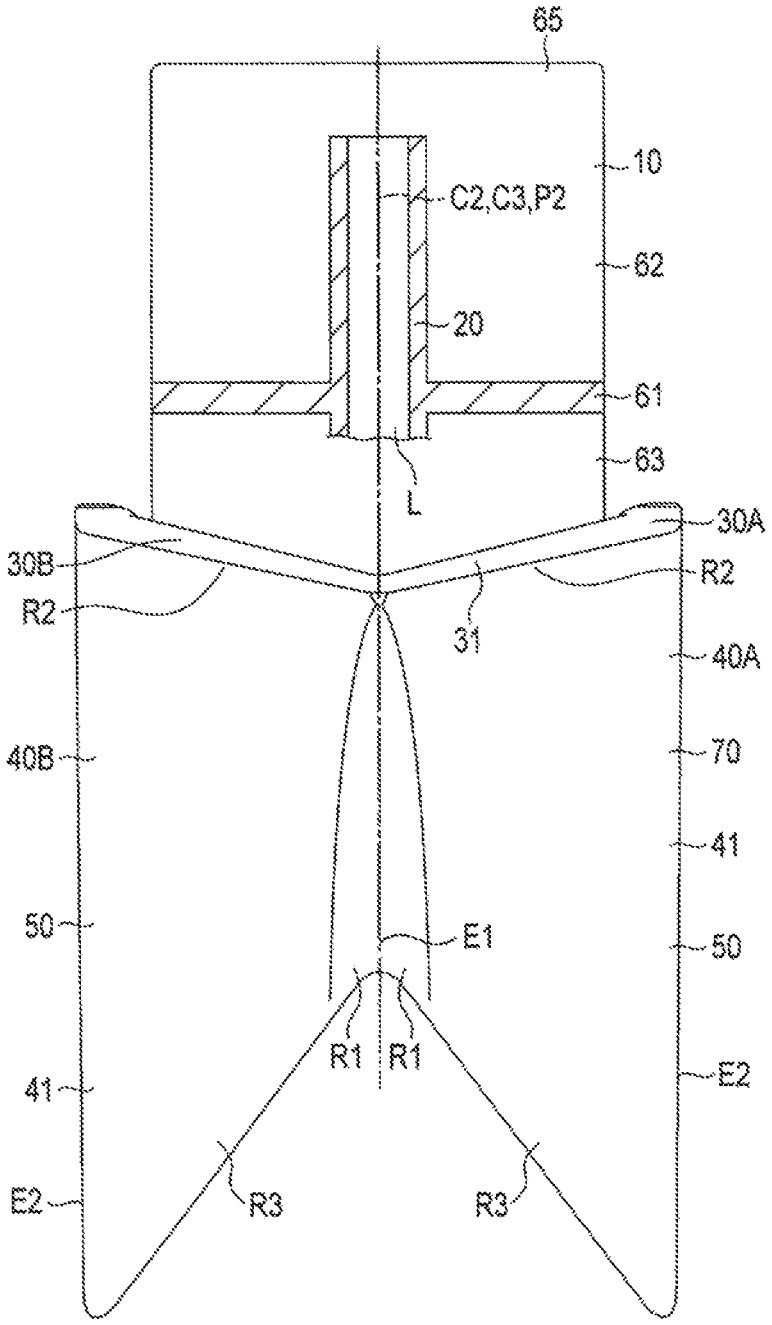
FIG. 4 is a cross-sectional view showing the container connector.
Figure 5:
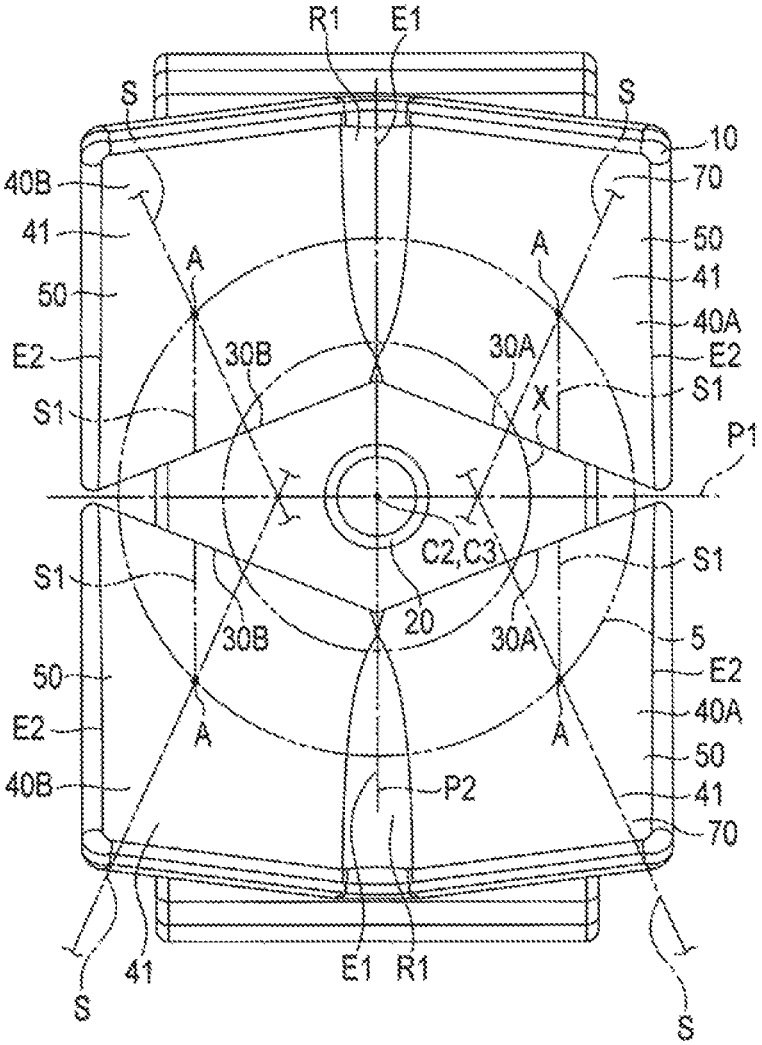
FIG. 5 is a bottom view showing the container connector.
Figure 6A:
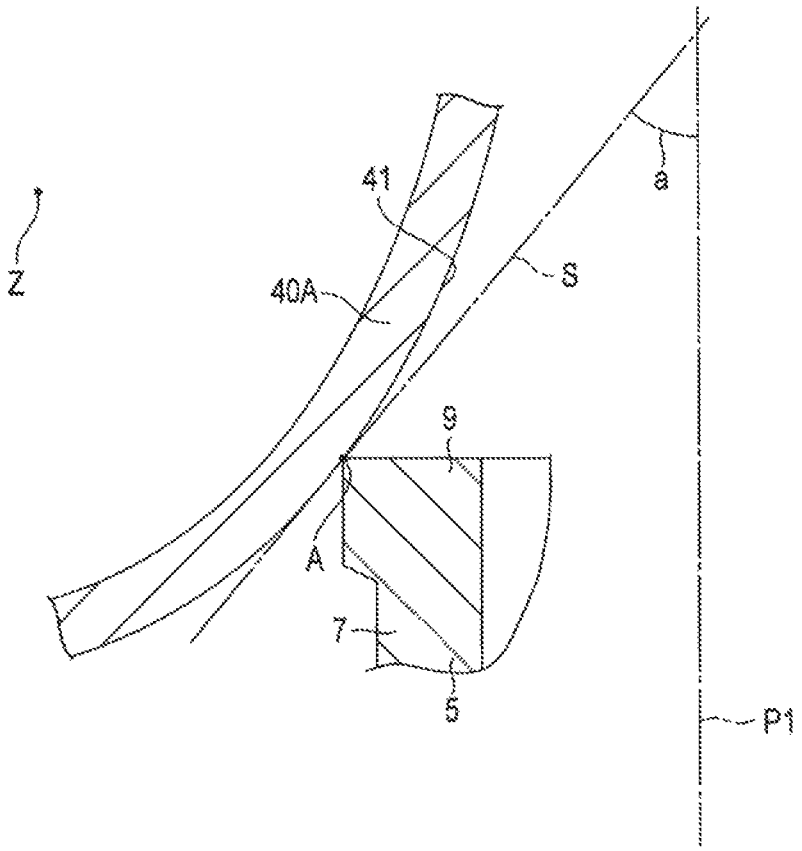
FIG. 6A is a cross-sectional view showing a main part of the container connector.
Figure 7:
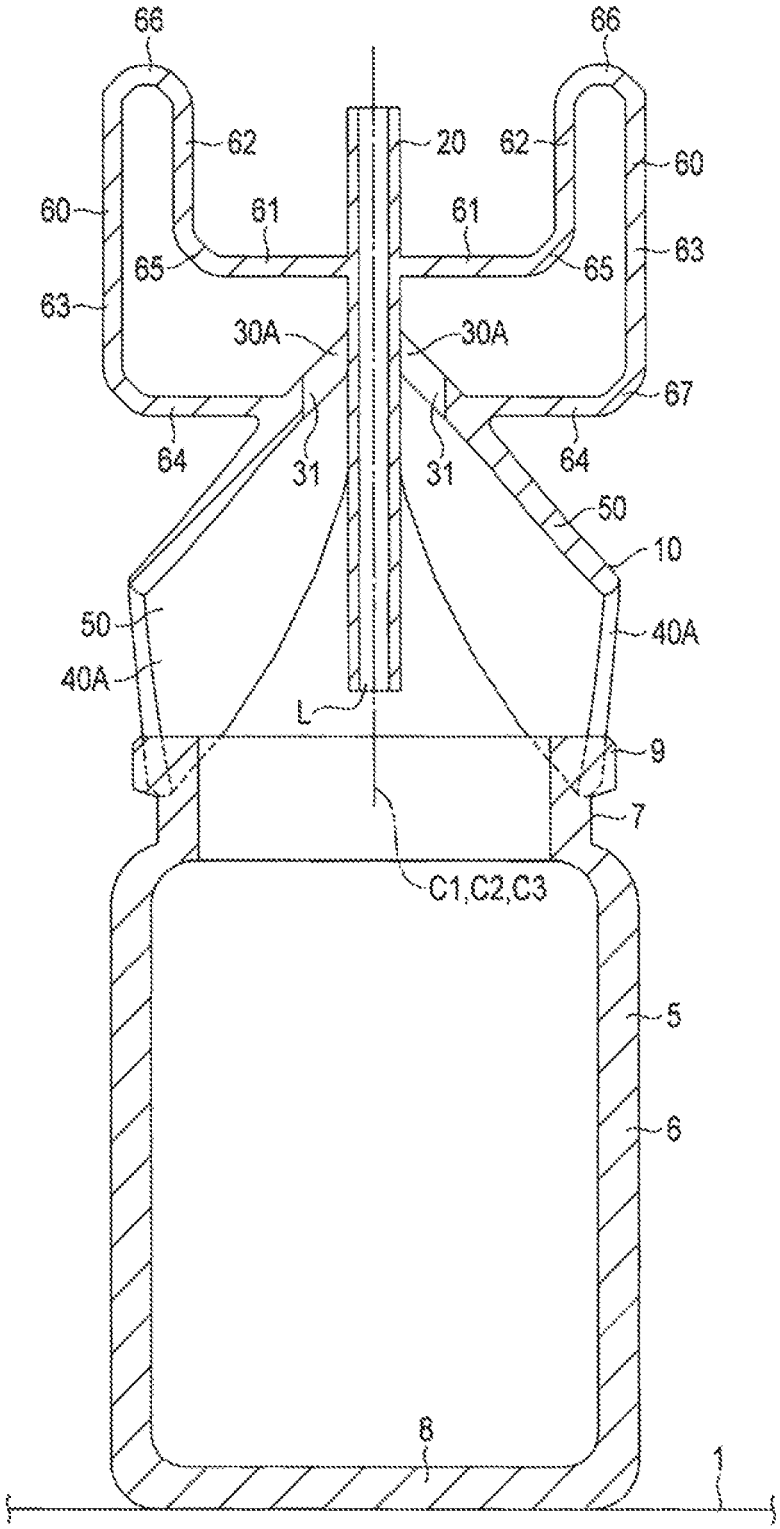
FIG. 7 is a cross-sectional view showing a process of connecting the container connector to the container.
Figure 8:
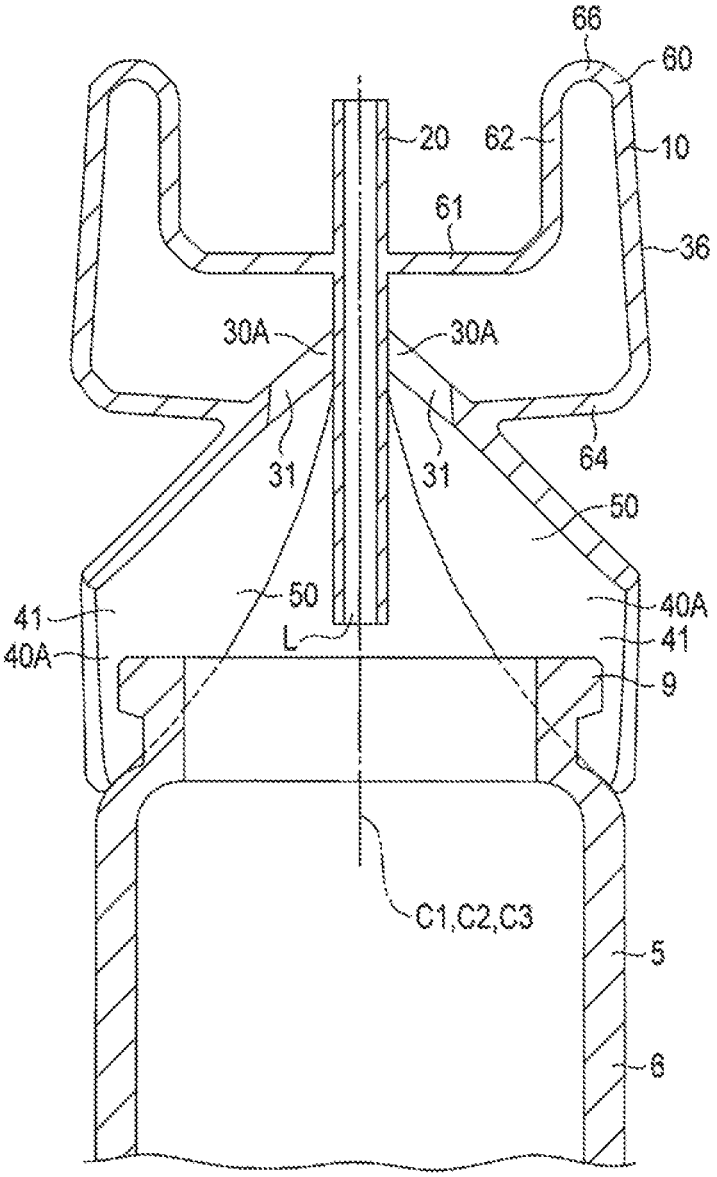
FIG. 8 is a cross-sectional view showing a process of connecting the container connector to the container.
Figure 9:
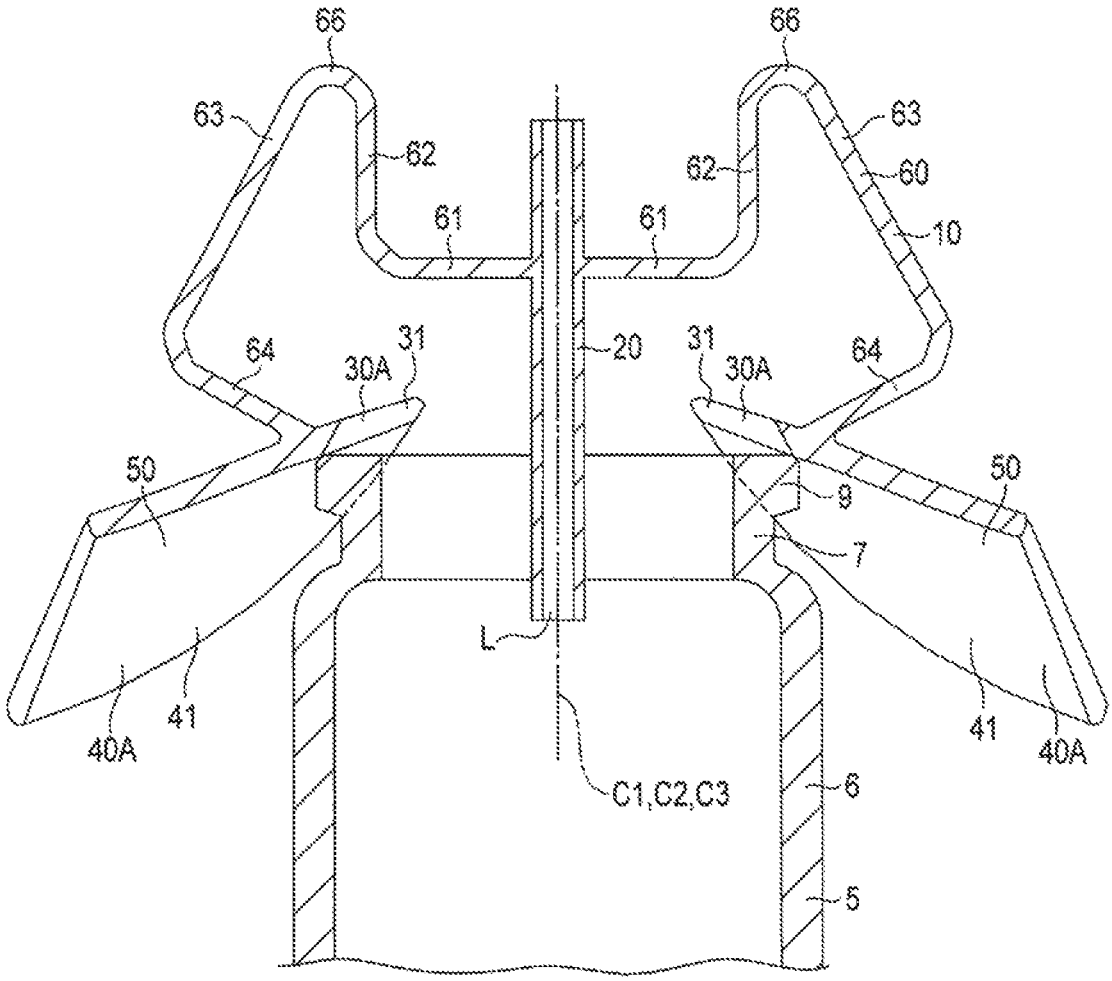
FIG. 9 is a cross-sectional view showing a process of connecting the container connector to the container.
Figure 10:
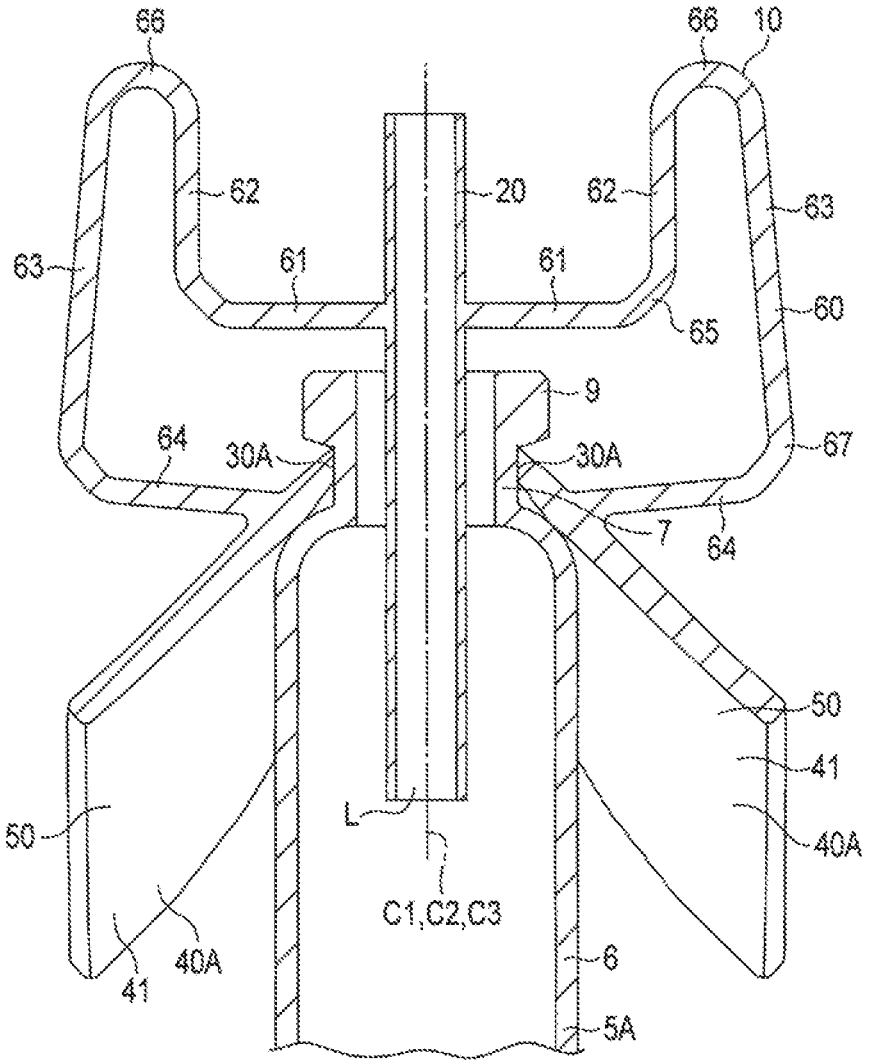
FIG. 10 is a cross-sectional view showing a state where the container connector is connected to a different container.

FIG. 3 is a side view showing the container connector 10. FIG. 4 is a cross-sectional view showing the container connector 10. FIG. 4 shows a state where the container connector 10 shown in FIG. 3 is rotated by 90 degrees about the axis of the base 20. FIG. 5 is a bottom view showing the container connector 10. FIG. 6A is a cross-sectional view showing a main part of the container connector 10. FIGS. 7 to 9 are cross-sectional views showing a process of connecting the container connector 10 to the container 5. FIG. 10 is a cross-sectional view showing a state where the container connector 10 is connected to another container 5.

First, description will be made as to the container 5 to which the container connector 10 is connected. As shown in FIG. 2, the container 5 is formed in a bottomed tubular shape that can contain a liquid, and includes a neck 7 having a cross section smaller than an opening end face in an upper part thereof.

In the present embodiment, as an example, the container 5 has a barrel 6 formed in a cylindrical shape, a bottom 8 formed at a bottom end of the barrel 6, the cylindrical neck 7 formed at an upper end of the barrel 6 and having a diameter smaller than a diameter of the barrel 6, and a cylindrical opening end portion 9 formed at an upper end of the neck 7 and having a diameter larger than a diameter of the neck 7. The barrel 6, the neck 7 and the opening end portion 9 are coaxially arranged.

Next, description will be made as to the container connector 10. As shown in FIG. 1 to FIG. 4, the container connector 10 includes the base 20 in which a flow path L is formed, a plurality of swinging sections 50 that are swingable to the base 20 and include an engagement section 30 that is engageable with the neck 7 of the container 5 and a guiding section 40 that can guide the container 5 to the engagement section 30, and arms 60 that swingably support the swinging sections 50 to the base 20.

The base 20 may be formed to be connectable to another container to which the liquid in the container 5 moves. In the present embodiment, as an example, the base 20 is formed in a cylindrical shape. The flow path L is disposed coaxially with the base 20.

Here, as shown in FIG. 5, a circle X is set for description of a position of the engagement section 30 of the swinging section 50. In the present embodiment, as an example, the circle X is set coaxially with the base 20.

Preferably three or more swinging sections 50, four swinging sections as an example in the present embodiment are provided. The engagement section 30 of each swinging section 50 is disposed on a circumference of the circle X set to the base 20. Furthermore, in the present embodiment, two swinging sections 50 are integrally formed, to constitute a swinging section constituting member 70. First, description will be made as to the arm 60 prior to description of the swinging section constituting member 70.

As shown in FIG. 1 to FIG. 3, two arms 60 are provided as an example in the present embodiment. One arm 60 supports one swinging section constituting member 70 to the base 20 so that two engagement sections 30 are swingable in directions toward and away from an axis C3 side of the circle X set to the base 20. The other arm 60 supports the other swinging section constituting member 70 and two engagement sections 30 to the base 20 swingably in the directions toward and away from the axis C3 side of the circle X set to the base 20. Note that the swinging referred to herein is an example of movement in the directions toward and away from the axis C3.

Two arms 60 are arranged at 180 degrees away from each other about the axis C3 of the circle X set to the base 20, and are configured to be swingable to each other in a radial direction of the circle X. The two arms 60 are formed symmetrically to a first virtual plane P1 that passes along the axis C3 of the circle X and is parallel to the axis C3. That is, the first virtual plane P1 is a plane that passes along an axis C2 of the base 20 and is parallel to the axis C2.

As shown in FIG. 1 and FIG. 3, the arm 60 has one end connected to the base 20, and the other end connected to the swinging section constituting member 70. The arm 60 has flexibility so that the swinging section constituting member 70, i.e., the swinging section 50 is swingable. Furthermore, the arm 60 has a middle portion located on a side opposite to the swinging section constituting member 70 via the one end of the arm 60 on a base 20 side so that the swinging section can swing the swinging section constituting member 70 relative to the base 20 with a comparatively small force.

Specifically, the arm 60 has a first portion 61 formed in a middle portion of the base 20 and extending outwardly from the base 20 in the radial direction, a second portion 62 that is continuous with the first portion 61 and extends from the base-side end of the first portion 61 to the side opposite to the swinging section constituting member 70, a third portion 63 turned up from the second portion 62 and extending to a swinging section constituting member 70 side, and a fourth portion 64 extending from the third portion 63 to the swinging section constituting member 70 side.

It is considered that a state where any external force is not applied to the arm 60 is an initial state of the arm 60. Description will be made as to the first portion 61 to the fourth portion 64 based on the initial state of the arm 60.

The first portion 61 as an example has both surfaces formed as flat plates orthogonal to the axis C3 of the circle X of the base 20. The second portion 62 as an example has both surfaces formed as flat plates parallel to the axis C3 of the circle X. A first ridge 65 between the first portion 61 and the second portion 62 has both surfaces formed as curved surfaces.

The third portion 63 as an example has both surfaces formed as flat surfaces parallel to both the surfaces of the second portion 62. A second ridge 66 between the third portion 63 and the second portion 62 has both surfaces formed as curved surfaces. In the present embodiment, the second ridge 66 as an example is located outside the base 20 in an axial direction of the base 20.

The fourth portion 64 as an example is formed in a flat plate shape having both surfaces formed as flat surfaces orthogonal to the axis C3 of the circle X. A third ridge 67 between the fourth portion 64 and the third portion 63 has both surfaces formed as curved surfaces.

The first portion 61, the second portion 62, the third portion 63 and the fourth portion 64 have a constant thickness as an example. Furthermore, in the present embodiment, the second ridge 66 may be formed to be thinner than the other portions so that the swinging section constituting member 70 swings mainly about the second ridge 66.

In the present embodiment, two first portions 61 are integrally formed. The two first portions 61 integrally formed have an area larger than a cross section of the base 20, and protrude outwardly from a peripheral surface of the base 20 in the radial direction.

Turn back to description of the swinging section constituting member 70. One swinging section constituting member 70 and the other swinging section constituting member are symmetrically formed relative to the first virtual plane P1 that passes along the axis C3 of the circle X and is parallel to the axis C3.

It is considered that one of two engagement sections 30 that the swinging section constituting member 70 has is a first engagement section 30A and that the other engagement section 30 has is a second engagement section 30B, which will be described below. Furthermore, it is considered that the guiding section 40 provided in the first engagement section 30A is a first guiding section 40A and that the guiding section 40 provided in the second engagement section 30B is a second guiding section 40B, which will be described below.

The first guiding section 40A and the second guiding section 40B are formed symmetrically to a second virtual plane P2 that passes along the axis C3 of the circle X set to the base 20 and is orthogonal to the first virtual plane P1. That is, the second virtual plane P2 is a plane that passes along the axis C2 of the base 20 and is parallel to the axis C2. In other words, the swinging section constituting member 70 is formed symmetrically with the second virtual plane P2. Consequently, a configuration of the second guiding section 40B is denoted with the same reference signs as in the first guiding section 40A and description is omitted.

The first guiding section 40A extends along the axis C3 of the circle X. An inner surface (a guide surface) 41 of the first guiding section 40A which faces an axis C3 side is formed as a curved surface that comes in contact with the opening end portion 9 of the container 5 and that can guide the container 5 to the first engagement section 30A. This curved surface has a center of a radius of curvature that is located outwardly in the radial direction of the curved surface, and the curved surface is formed to broaden toward bottom from upside to downside in the axial direction. In other words, the curved surface is configured so that an inclination angle of a tangent line to the first virtual plane P1 decreases with closer proximity to the engagement section.

The inner surface 41 will be described with reference to FIG. 6A. FIG. 6A is a cross-sectional view showing a state where the opening end portion 9 of the container 5 is in contact with the inner surface 41, and a state where the inner surface is cut along a cross section that passes along a contact A of the inner surface 41 and the container 5 and is parallel to the axis C3 of the circle X set to the base 20 and a tangent line S of the contact A. The tangent line S of the contact A is shown with a one-dot chain line in FIG. 5.

As shown in FIG. 6A, the inner surface 41 is formed as a curved surface so that the tangent line S passing along the contact A in contact with the opening end portion 9 is inclined at an angle $\alpha$ to the first virtual plane P1. The angle $\alpha$ is less than 90 degrees.

As shown in FIG. 6A, the inner surface 41 is formed as a curved surface so that a center Z of curvature is located on a side opposite to the plane P1 via the inner surface 41. In other words, the inner surface 41 broadens toward the bottom from the upside to the downside in the axial direction of the circle X, i.e., the inner surface is formed in a shape away from the axis C3 as being downwardly from the upside. Furthermore, in other words, the inner surface 41 is formed as the curved surface so that the inclination angle $\alpha$ of the tangent line S of the inner surface 41 to the first virtual plane P1 decreases with closer proximity to the engagement section 30 from the downside.

Furthermore, in a cross section of the first guiding section 40A which is orthogonal to the axis C3 of the circle X, as shown in FIG. 5, one side end E1 of the inner surface 41 on a second virtual plane P2 side is located at a position away from the axis C3 to the other side end E2 of the inner surface 41 on a side opposite to the second virtual plane P2 in a direction orthogonal to the axis C3 and parallel to the second virtual plane P2.

Furthermore, the one side end E1 of the inner surface 41 is formed as a straight line or a curved line. Note that in the present embodiment, the one side end E1 is formed as the straight line.

Additionally, the inner surface 41 is formed as a curved surface so that the radius of curvature decreases from a vicinity of the one side end E1 toward the other side end E2. In the present embodiment, a region R1 in the vicinity of the one side end E1 of the inner surface 41 is formed as a flat surface. This flat surface is a flat surface parallel to the one side end E1. Note that the region formed in the flat surface is small. This region is a region with which the container 5 is not in contact.

Consequently, in the present embodiment, a region from the vicinity of the one side end E1 of the inner surface 41 to the other side end E2 is formed as a curved surface. Furthermore, in the region formed in the curved surface of the inner surface 41, one end on a side of the one side end E1 has the largest radius of curvature, and the radius of curvature decreases as being toward the other side end E2. Furthermore, the radius of curvature of the other side end E2 is smallest. Note that in a case where the one side end E1 is formed as the curved line, the radius of curvature of the one side end E1 is largest.

Furthermore, the inclination angle $\alpha$ of the tangent line S of one end of the other side end E2 of the inner surface 41 on an engagement section 30 side to the first virtual plane P1 is smaller than the inclination angle $\alpha$ of an extension of the one side end E1 of the inner surface 41 to the first virtual plane P1. Furthermore, the tangent line S of one end, i.e., a lower end of the other side end E2 of the inner surface 41 on a side opposite to the engagement section 30 has the inclination angle $\alpha$ to the first virtual plane P1 which is larger than the inclination angle $\alpha$ of the extension of the one side end E1 of the inner surface 41 to the first virtual plane P1.

Additionally, in the present embodiment, as shown in FIG. 4, in an upper end portion R2 of the inner surface 41, the inclination angle $\alpha$ of the tangent line S to the first virtual plane P1 decreases as being from the one side end E1 toward the other side end E2. The upper end portion R2 is a region in a vicinity of a tip surface 31 of the engagement section 30 in the inner surface 41. Furthermore, in a lower end portion R3 of the inner surface 41, the inclination angle $\alpha$ of the tangent line S to the first virtual plane P1 increases as being from the one side end E1 toward the other side end E2. The lower end portion R3 is a region in a vicinity of a lower end of the inner surface 41.

Figure 6B:
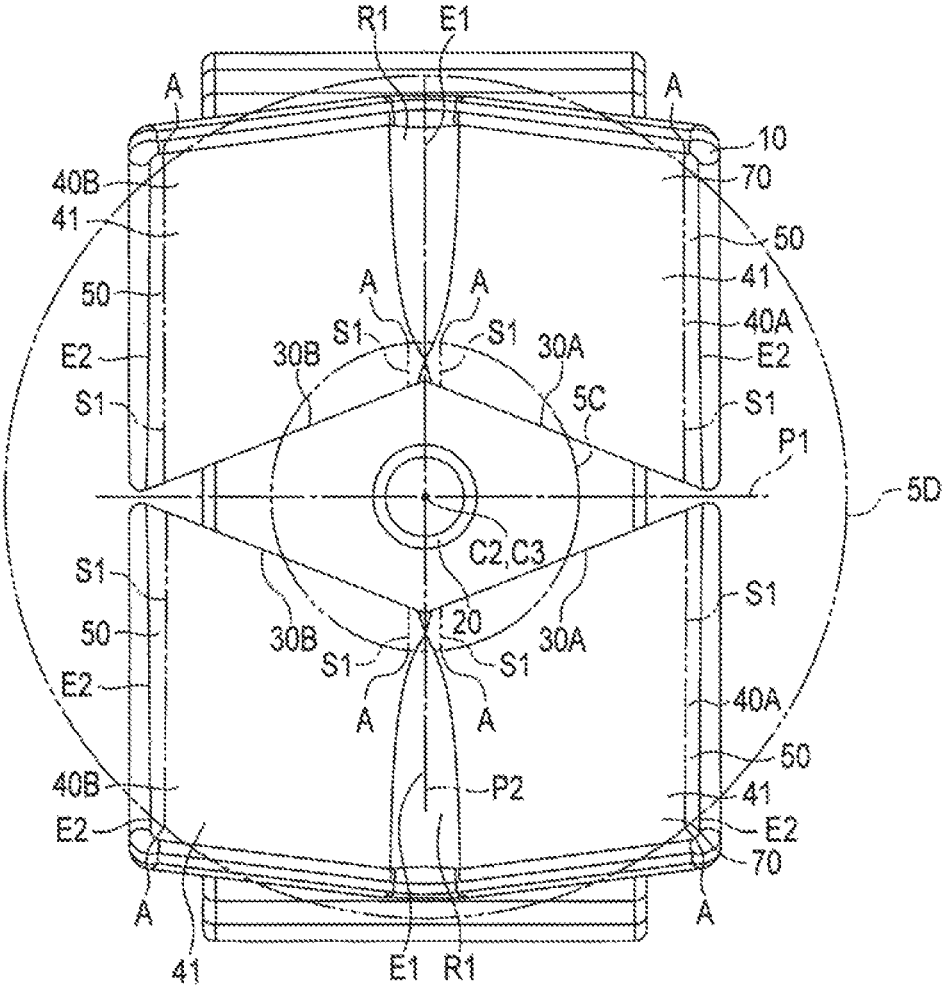
FIG. 6B is a bottom view showing the container connector.

Furthermore, in the present embodiment, the inner surface 41 as an example is configured so that a container 5D in which an outer diameter of the opening end portion 9 is 32 mm at maximum, i.e., the container 5D having a bore diameter of 32 mm can be guided to the engagement section 30. FIG. 6B shows a container 5C having a bore diameter (the outer diameter of opening end portion 9) that is 13 mm and the container 5D having a bore diameter of 32 mm with two-dot chain lines.

The contact A between the inner surface 41 and the container 5 moves in the inner surface 41, when the container connector 10 is pushed into the container 5. A locus of the contact A is a contact line S1. The contact line S1 of the inner surface 41 and the container 5D is disposed in the vicinity of the one side end E1 in a region formed in the curved surface of the inner surface 41. The contact line S1 of the inner surface 41 and the container 5C is disposed in a vicinity of the other side end E2. As shown in FIG. 6B, the contact line S1 is a straight line parallel to the second virtual plane P2 when seen from below.

Thus, in the container connector 10, a contact position of the container 5 and the inner surface 41 differs in an extending direction of the first virtual plane P1 in accordance with a size of the bore diameter of the container 5. Specifically, in case of the container 5 having a small diameter, the contact line S1 is located on the one side end E1 side in the extending direction of the first virtual plane P1. In case of the container 5 having a large diameter, the contact line S1 is located in the vicinity of the other side end E2 in the extending direction of the first virtual plane P1.

Furthermore, as an operation of connecting the container connector 10 to the container 5 proceeds, the inner surface 41 is expanded by the container 5 to move away from the axis C3 of the circle X. Consequently, the inclination angle $\alpha$ of the tangent line S to the first virtual plane P1 at the same location of the inner surface 41 increases in a state where the guiding section 40 is expanded by the container 5 as compared with a state where the guiding section 40 is not expanded.

However, the inner surface 41 is formed as the curved surface, so that an increase amount of the inclination angle $\alpha$ which is caused by the proceeding of the connection of the container connector 10 to the container 5 can be reduced. Furthermore, in the present embodiment, the inner surface 41 is formed as the curved surface having the above described characteristics, so that the increase amount of the inclination angle $\alpha$ of the tangent line S to the first virtual plane P1, which is caused by the proceeding of the connection of the container connector 10 to the container 5, can further be reduced in any portion of the inner surface 41. That is, an increase width of the angle $\alpha$ can be decreased.

That is, to engage the container connector 10 with the neck 7 of the container 5, when the container connector 10 is pushed into a container 5 side in a state where the opening end portion 9 of the container 5 is in contact with the inner surface 41 of the first guiding section 40A, the first guiding section 40A is expanded in the direction away from the axis C3 of the circle X.

Thus, the first guiding section 40A is expanded, whereby a position of the contact A of the inner surface 41 with the container 5 changes. The inner surface 41 is formed as the curved surface so that the angle $\alpha$ does not noticeably change as described above, even when the position of the contact A changes. In the present embodiment, the angle $\alpha$ is about 45 degrees.

Similarly, as for the inner surface 41 of the second guiding section 40B, the inclination angle $\alpha$ of the tangent line S to the axis C3 at the contact A of the inner surface 41 with the container 5 does not noticeably change irrespective of deformation of a posture of the second guiding section 40B.

Furthermore, the inner surface 41 of the second guiding section 40B, which is cut along the cross section orthogonal to the axis C3 of the circle X, forms an almost V-shape together with the inner surface 41 of the first guiding section 40A. In other words, in the cross section of the guiding section 40A or 40B which is orthogonal to the axis C3 of the circle X, the one side end of the inner surface 41 on the second virtual plane P2 side is located at a position away from the axis C3 relative to the other side end of the inner surface 41 on the side opposite to the second virtual plane P2 in a direction orthogonal to the axis C3 and parallel to the second virtual plane P2.

The first engagement section 30A is formed in an end portion of the first guiding section 40A on a first portion 61 side. In front view seen from inside in the radial direction of the circle X, as shown in FIG. 4, one end of the first engagement section 30A on a second engagement section 30B side is formed to be lower than the other end. The tip surface 31 of the first engagement section 30A faces the axis C3 of the circle X. That is, an angle between the tip surface 31 of the first engagement section 30A and an outer surface of the first engagement section 30A is an acute angle. The tip surface 31 is formed as a flat surface and an inclined surface having an extension surface inclined to the axis C3 of the circle X. The extension surface inclined to the axis C3 indicates that an angle formed by the extension surface and the axis C is an angle other than 90 degrees.

The second engagement section 30B is formed symmetrically with the first engagement section 30A relative to the second virtual plane P2. Consequently, a configuration of the second engagement section 30B is denoted with the same reference signs as in the first engagement section 30A and description is omitted. The tip surface 31 of the second engagement section 30B forms the V-shape together with the tip surface 31 of the first engagement section 30A as shown in FIG. 4.

Next, an example of the operation of connecting the container connector 10 to the container 5 will be described with reference to FIG. 2, FIG. 5, and FIG. 7 to FIG. 9. FIG. 7 to FIG. 9 show a state where the container connector 10 and the container 5 are cut along the second virtual plane P2. That is, FIG. 7 to FIG. 9 show a state where the container connector 10 and the container 5 are cut along a cross section that passes along the axis C3 of the circle X and is parallel to the axis C3.

First, an operator places the container 5 on a workbench 1 as shown in FIG. 7. A direction orthogonal to an upper surface of the workbench 1 is parallel to an up-down direction, i.e., a gravity direction and its reverse direction in the present embodiment. When the container 5 is placed on the workbench 1, the axis C1 of the container 5 is parallel to the up-down direction.

When placing the container 5 on the workbench 1, the operator aligns a position of the container connector 10 with the container 5 in a posture in which the axis C2 of the base 20 is parallel to the up-down direction, and moves the container connector 10 to the container 5 side to bring the container connector into contact with the container 5.

When the container connector 10 comes in contact with the opening end portion 9 of the container 5 in a posture in which the axis C2 of the base 20 is parallel to or substantially parallel to the up-down direction, the inner surfaces 41 of two first guiding sections 40A and the inner surfaces 41 of two second guiding sections 40B come in contact with an outer peripheral portion of the opening end portion 9 of the container 5. That is, the container connector 10 comes in contact with the container 5 at four points.

When the inner surfaces 41 of the two first guiding sections 40A and the inner surfaces 41 of the two second guiding sections 40B are brought into contact with the opening end portion 9 of the container 5, the operator pushes the container connector 10 downwardly as shown in FIG. 8. When the container connector 10 is further pushed downwardly, the two first guiding sections 40A and the two second guiding sections 40B receive a force from the contact A with the container 5 in the direction away from the axis C3 of the circle X. This force is a component that acts in the direction orthogonal to the axis C3 of the circle X in reaction received from the opening end portion 9 of the container 5 by pushing the container connector 10 downwardly.

When the first guiding section 40A and the second guiding section 40B receive the force in the direction away from the axis C3 of the circle X, that is, when two swinging section constituting members 70 receive the force, the arms 60 bend. When the arms 60 bend, the two swinging section constituting members 70 swing mainly about the second ridges 66 of the arms 60 in the direction away from the axis C3. By this swinging, the two swinging section constituting members 70 are expanded, whereby the posture to the axis C3 of the circle X changes.

Note that even when the posture of the swinging section constituting member 70 changes, the increase amount of the inclination angle α of the tangent line S at the contact A of four inner surfaces 41 relative to the first virtual plane P1 is small from the time when an operation of pushing the container connector 10 into the container 5 is started. Consequently, the operator can push the container connector 10 with a substantially constant force.

When the container connector 10 is pushed into the container 5 to reach a predetermined position, the two swinging section constituting members 70 are expanded so that the first engagement section 30A and the second engagement section 30B reach a position to come in contact with an outer peripheral edge of the opening end portion 9 of the container 5 as shown in FIG. 9. FIG. 5 shows the contact line S1 of the contact A with a two-dot chain line. The contact line S1 is the locus of the contact A of the inner surface 41. The contact line S1 is parallel to the second virtual plane P2.

When the container connector 10 is further pushed downwardly, the first engagement section 30A and the second engagement section 30B come in contact with an outer peripheral surface of the opening end portion 9 of the container 5. When the container connector 10 is further pushed downwardly, the first engagement section 30A and the second engagement section 30B are moved below the outer peripheral surface of the opening end portion 9 of the container 5.

When the container connector 10 is further pushed downwardly, two first engagement sections 30A and two second engagement sections 30B face the neck 7 of the container 5. The first engagement section 30A and the second engagement section 30B face the neck 7, and then abut on the neck 7 to engage with the neck 7 by resilience of the arm 60 as shown in FIG. 2.

At this time, tips formed at the acute angle of the two first engagement sections 30A and tips formed at the acute angle of the two second engagement sections 30B come in contact with an outer peripheral surface of the neck 7. That is, the two first engagement sections 30A and the two second engagement sections 30B come in contact with the neck 7, whereby the container connector 10 comes in contact with the neck 7 at four points.

Thus, the container connector 10 is expanded in accordance with the outer diameter of the opening end portion 9 of the container 5 until two first engagement sections 30A and two second engagement sections 30B engage with the neck 7. Consequently, as shown in FIG. 10, the container connector 10 can be connected to another container 5A including an opening end portion 9 having a different outer diameter.

The container connector 10 having such a configuration includes two first guiding sections 40A and two second guiding sections 40B. Consequently, in a process of guiding the container 5 to the first engagement section 30A and the second engagement section 30B, the container connector comes in contact with the outer peripheral edge of the opening end portion 9 of the container 5 at four points. Thus, the container connector 10 comes in contact with the outer peripheral edge of the opening end portion 9 of the container 5 at three or more points, so that relative movement of the container 5 relative to the container connector 10 can be guided while the posture of the container connector 10 is stabilized.

Furthermore, two first engagement sections 30A and two second engagement sections 30B of the container connector engage with the neck 7. Consequently, the container connector 10 comes in contact with the neck 7 at four points in a state where the container connector is connected to the container 5, that is, in a state where two first engagement sections 30A and two second engagement sections 30B are engaged with the neck 7. Therefore, the posture of the container connector 10 connected to the container 5 can be stabilized.

Additionally, simply by pushing the container connector 10 into the container 5 in one direction, the container 5 is guided by two first engagement sections 30A and two second engagement sections 30B. Consequently, the two first engagement sections 30A and the two second engagement sections 30B can be simply engaged with the neck 7. Furthermore, by forming the inner surface 41 as the curved surface, the increase amount of the inclination angle α which is caused by the proceeding of the connection of the container connector 10 to the container 5 can be reduced. Therefore, the container 5 can be smoothly guided to the engagement section 30.

Furthermore, the inner surfaces 41 of two first guiding sections 40A and the inner surfaces 41 of two second guiding sections 40B are formed as the curved surfaces in each of which a change amount of the inclination angle α of the tangent line S at the contact A to the first virtual plane P1 is small. That is, each inner surface is formed as the curved surface so that there further decreases the increase amount of the inclination angle α of the tangent line S to the first virtual plane P1 when seen as shown in FIG. 6A from the start of the operation of pushing the container connector 10 into the container 5 to the state where the container connector 10 is engaged with the container 5. Consequently, as for the force of the reaction received by the container 5 in pushing the container connector 10 into the container 5, the component of the force that acts in a direction to expand the two first guiding sections 40A and the two second guiding sections 40B can be substantially constant. Consequently, the pushing force of the container connector 10 by the operator can be substantially constant. Thus, since the container connector 10 can be smoothly pushed into the container 5, the container connector 10 can be smoothly engaged with the container 5. Furthermore, in the present embodiment, the inclination angle of the tangent line S of each of the inner surfaces 41 of the two first guiding sections 40A and the inner surfaces 41 of the two second guiding sections 40B to the first virtual plane P1 can be maintained at about 45 degrees. Therefore, the container connector 10 can be more smoothly engaged with the container 5.

Additionally, the arm 60 has the second portion 62 and the third portion 63, so that a distance mainly from the second ridge 66 of a swing center about which the swinging section constituting member 70 swings to the swinging section constituting member 70 can increase. Consequently, a swing angle of the swinging section constituting member 70 which is required to engage two first engagement sections 30A and two second engagement sections 30B with the neck 7 of the container 5 can be acquired while minimizing a deformation amount of the arm 60. Furthermore, since the deformation amount of the arm 60 can be minimized, the force to push the container connector 10 can be minimized.

Furthermore, when the container connector 10 is connected to the container 5, a mouth of the container 5 having the small diameter can be brought into contact with a region close to the one side end E1 of the inner surface 41 of the guiding section 40, and a mouth of the container 5 having the large diameter can be brought into contact with a region close to the other side end E2 of the inner surface 41. That is, the position of the inner surface 41 that comes in contact with the container 5 can be changed in accordance with a size of the container 5. Therefore, as for a shape of the inner surface 41, a portion of the inner surface that comes in contact with the container 5 having the small diameter is formed in a shape suitable for the container 5 having the small diameter, and a portion of the inner surface that comes in contact with the container 5 having the large diameter is formed in a shape suitable for the container 5 having the large diameter. Consequently, even when the outer diameter of the container 5 differs, the container connector can be easily connected to the container.

Next, connection equipment 80 including a container connector 10A according to a second embodiment of the present invention will be described with reference to FIG. 11 to FIG. 15. The connection equipment 80 is for use in collecting a chemical solution to a syringe 3 from a container 5B such as a vial that contains the chemical solution. The container 5B is connected to the syringe 3, to form a liquid flow path L1 through which the chemical solution flows and a gas flow path L2 via which an interior of the container 5 is in communication with an interior of an after-mentioned air bag 100, in a space between the interior of the container 5B and the interior of the syringe 3.

Note that a configuration having a function similar to a function of the first embodiment is denoted with the same reference signs as in the first embodiment and description is omitted. In the present embodiment, the container connector 10A is configured to be connectable to the container 5B. Furthermore, the container connector 10A is configured to be connectable to a syringe connector 85.

Figure 11:
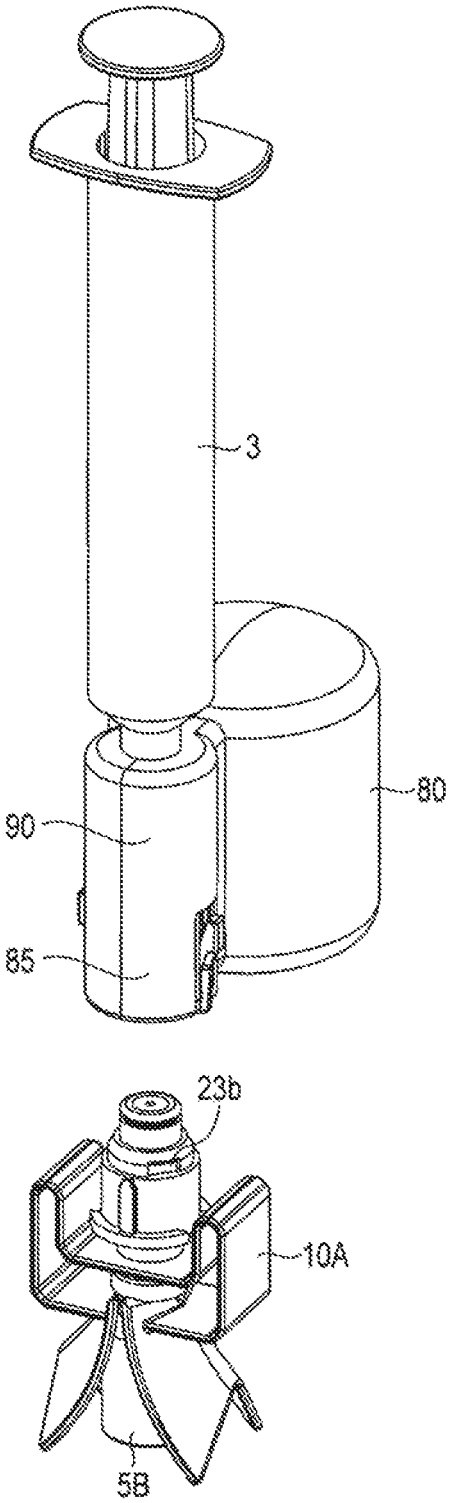
FIG. 11 is a perspective view showing connection equipment including a container connector according to a second embodiment of the present invention.
Figure 12:
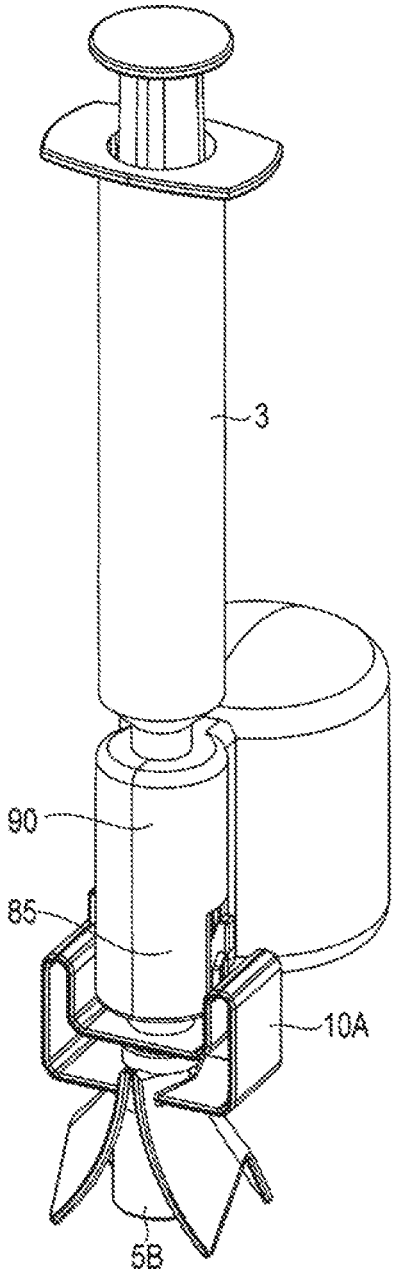
FIG. 12 is a perspective view showing a state where the container connector and a syringe connector of the connection equipment are connected.

FIG. 11 is a perspective view showing a state where the container connector 10A is connected to the container 5B, and a state where the syringe connector 85 is connected to the syringe 3. In FIG. 11, the container connector 10A is separated from the syringe connector 85. FIG. 12 is a perspective view showing a state where the container connector 10A connected to the container 5B is connected to the syringe connector 85 to which the syringe 3 is attached.

Figure 13:
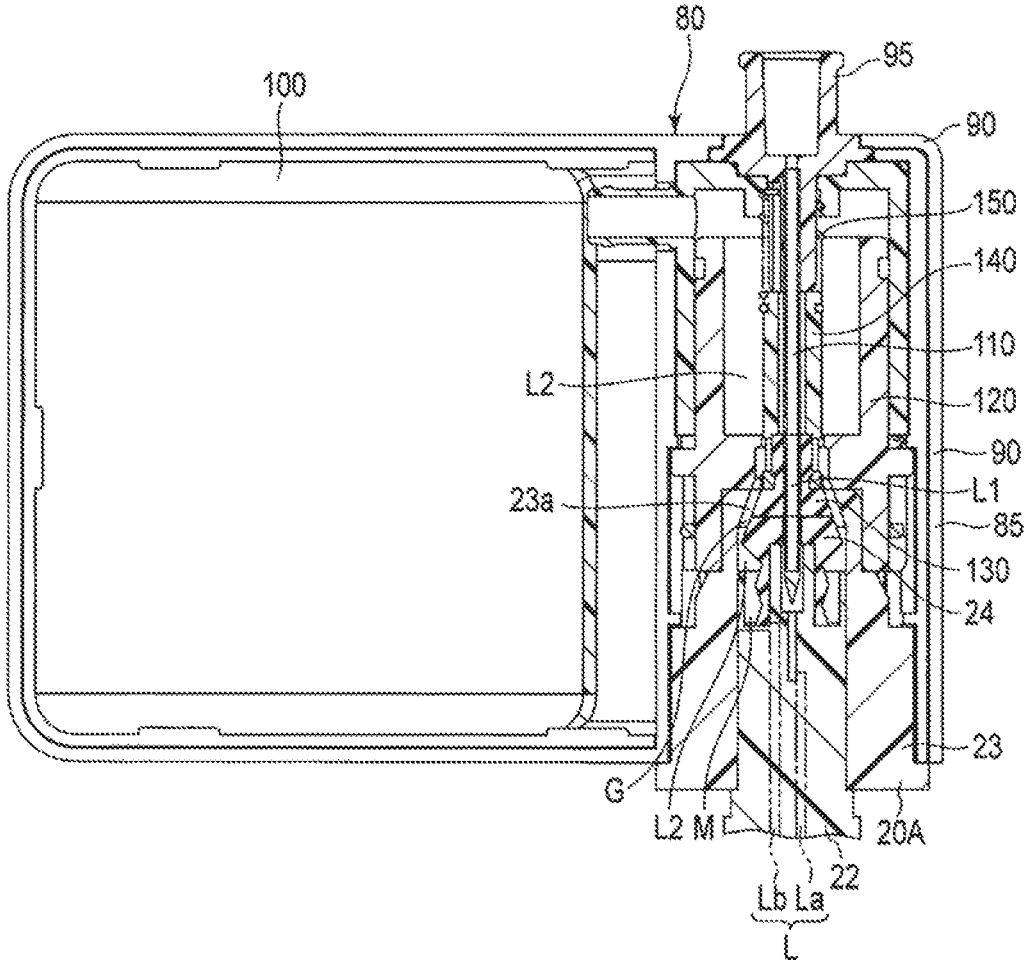
FIG. 13 is a cross-sectional view showing a state where the container connector and the syringe connector are connected.
Figure 14:
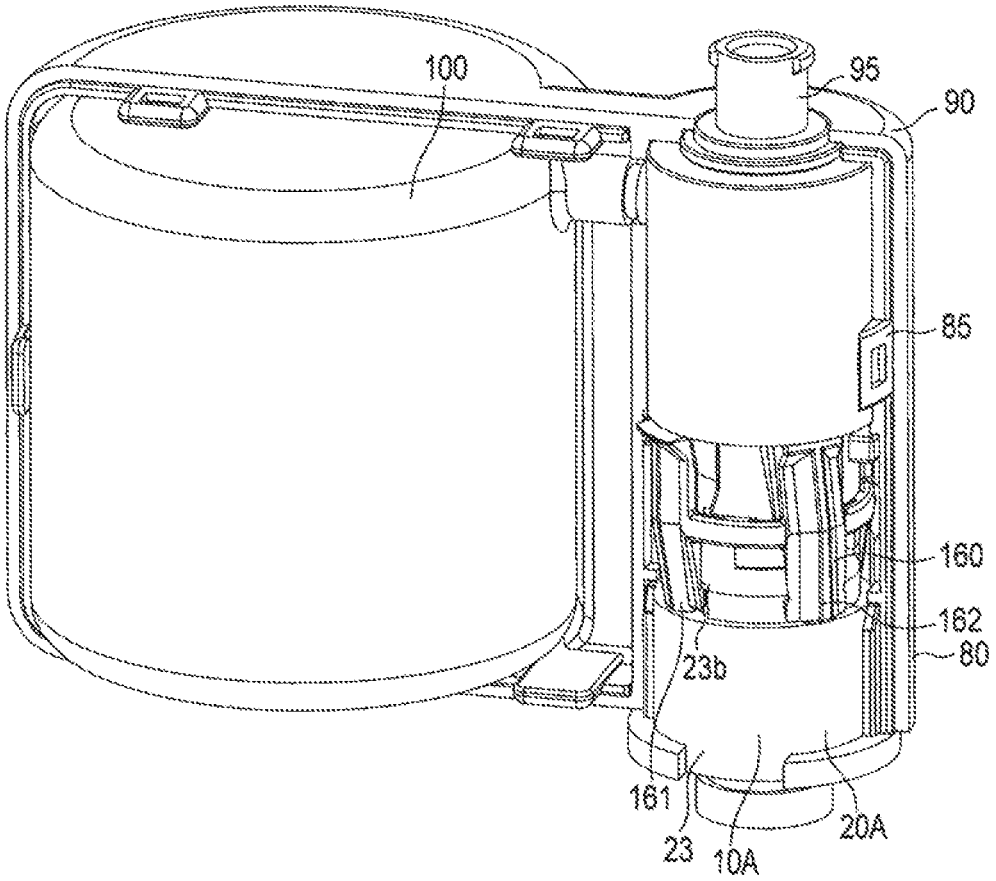
FIG. 14 is a partially exploded perspective view of an outer shell body of the syringe connector, showing a state where the container connector and the syringe connector are connected.
Figure 15:
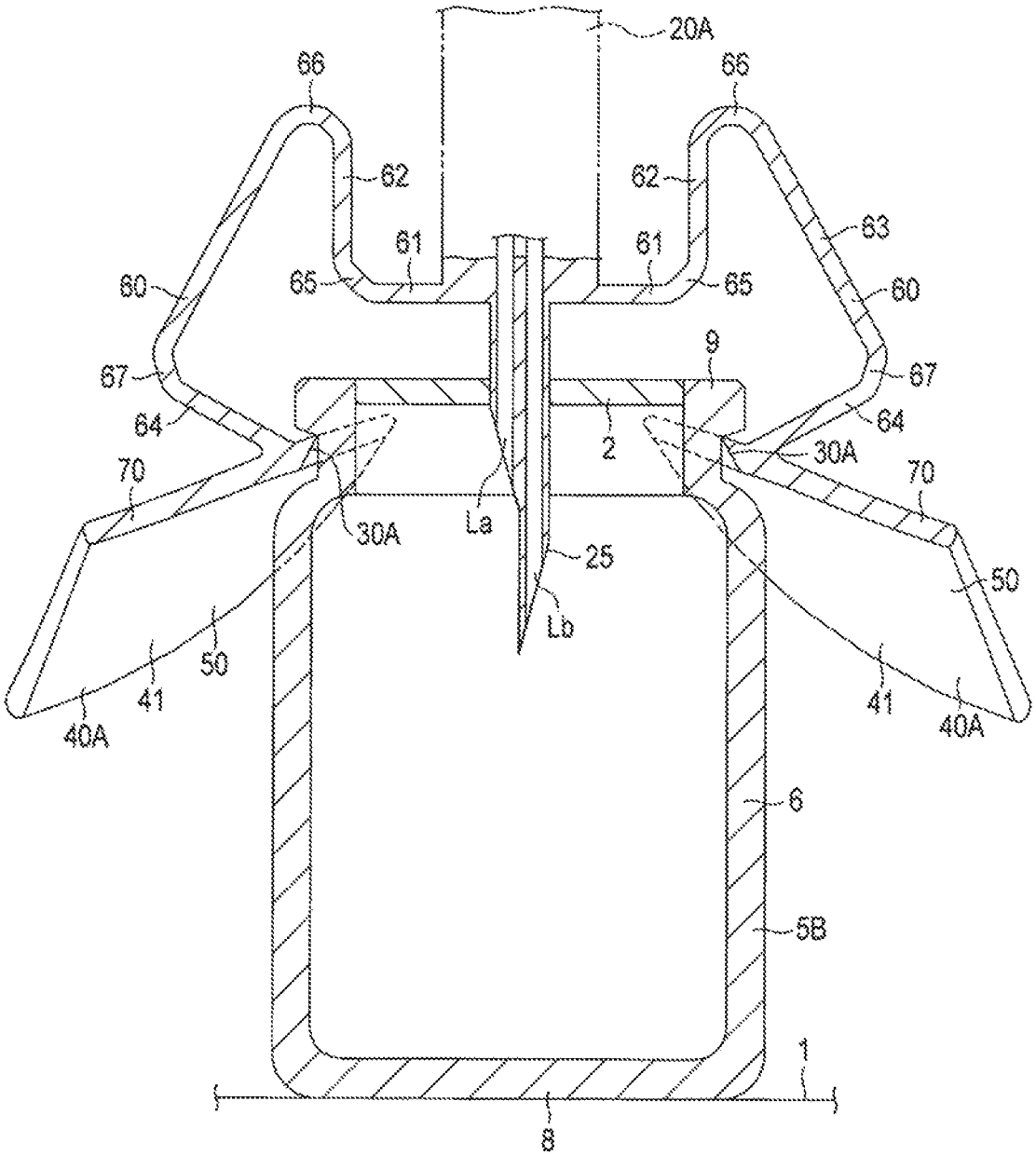
FIG. 15 is a cross-sectional view showing a state where the container connector is connected to the container.

FIG. 13 is a cross-sectional view showing a state where the container connector 10A is connected to the syringe connector 85. FIG. 14 is a partially exploded perspective view of a part of an outer shell body 90 of the syringe connector 85, showing the state where the container connector 10A is connected to the syringe connector 85. FIG. 13 and FIG. 14 do not show a part of the container connector 10A other than a base 20A. FIG. 15 is a cut, cross-sectional view showing a state where the syringe connector 85 is connected to the container connector 10A. FIG. 15 does not show the base 20A.

As shown in FIG. 15, the container 5B is a vial that contains a chemical solution therein. The container 5B includes a barrel 6, a bottom 8, a neck 7, an opening end portion 9, and a seal 2 that liquid-tightly seals an opening of the opening end portion 9. The seal 2 is made of, for example, a rubber.

As shown in FIG. 14 and FIG. 15, the container connector 10A includes the base 20A that forms a part of the liquid flow path L1 and a part of the gas flow path L2, a needle 25 provided in the base 20A, two swinging section constituting members 70, and two arms 60 that swingably support the swinging section constituting members 70 to the base 20A.

As shown in FIG. 13, the base 20A includes a base main body 22 having therein a part La (shown with a two-dot chain line) of the liquid flow path L1 and a part Lb (shown with a two-dot chain line) of the gas flow path L2, a cylindrical base cap 23 that contains the base main body 22 therein, and a seal 24 for the container connector that liquid-tightly and air-tightly seals an opening of the base cap 23.

The base main body 22 is formed in a columnar shape. In the base main body 22, the part La of the liquid flow path L1 and the part Lb of the gas flow path L2 are formed. The part La is open in an upper surface of the base main body 22. The part Lb is open in the upper surface via a groove M formed in an outer peripheral portion of the base main body 22. The base cap 23 is disposed coaxially with the base main body 22. A recess 23*b* with which a claw 161 of an after-mentioned stopper sleeve 160 engages is formed in an outer peripheral surface of the base cap 23. A gap G is provided between tips of the base main body 22 and the base cap 23. The part Lb communicates with the gap G via the groove M. The seal 24 for the container connector is provided in this gap G. The seal 24 for the container connector is formed to be displaceable in the base cap 23 relative to an opening 23*a* of the base cap 23. When the seal 24 for the container connector is displaced, the opening 23*a* is unsealed. A first portion 61 of the arm 60 is fixed to a lower end of the base 20A.

The needle 25 is formed at a lower end of the base main body 22. In the needle 25, the part La and the part Lb are formed. The needle 25 is formed to break through the seal 2 in a state where two first engagement sections 30A and two second engagement sections 30B are engaged with the neck 7 of the container 5B, so that the needle can be disposed in the container 5B. The needle 25 is disposed coaxially with the base main body 22. In the present embodiment, a circle X is disposed coaxially with the base main body 22. That is, a first virtual plane P1 and a second virtual plane P2 are planes that pass along an axis of the base main body 22 and an axis of the needle 25.

As shown in FIG. 12 to FIG. 15, the syringe connector 85 includes the outer shell body 90 defining an outer shell of the syringe connector 85*a* and having a syringe attaching section 95 to which the syringe 3 is removably attached, and the air bag 100 stored in the outer shell body 90. The air bag 100 communicates with an interior of the outer shell body 90.

Furthermore, the syringe connector 85 includes a needle 110 that is fixed to the interior of the outer shell body 90 and that communicates with the syringe 3 via the syringe attaching section 95, and a tubular head sleeve 120 that is movably stored in the outer shell body 90 and that stores a part of the needle 110 therein. The head sleeve 120 is formed so that a part of the base 20A of the container connector 10A is insertable in the sleeve.

Additionally, the syringe connector 85 includes a needle seal 130 stored in the outer shell body 90 and formed to be capable of selectively sealing a lower end opening of the head sleeve 120, a needle seal holder 140 stored in the outer shell body 90 and holding the needle seal 130, and an urging member 150 that urges the needle seal 130 to the head sleeve 120.

The needle seal holder 140 is formed in a tubular shape. The needle seal holder 140 has a lower end to which the needle seal 130 is fixed. The urging member 150 is, for example, a coil spring. The urging member 150 is fixed to an upper end of the needle seal holder 140, and the outer shell body 90. The urging member 150 urges the needle seal holder 140 upwardly, whereby the needle seal 130 seals the lower end opening of the head sleeve 120.

Furthermore, the syringe connector 85 includes the stopper sleeve 160 formed so that the head sleeve 120 is selectively fixable to the outer shell body 90 and the head sleeve 120 and the base 20A of the container connector 10A are selectively fixable.

The stopper sleeve 160 is formed in a tubular shape, in which the head sleeve 120 is disposed. The stopper sleeve 160 is fixed to the head sleeve 120. The stopper sleeve 160 includes the first claw 161 and a second claw 162.

The first claw 161 is formed to be engageable with the recess 23*b* of the base cap 23. The second claw 162 is configured to engage with, for example, a protrusion formed on an inner surface of the outer shell body 90 in a state where the head sleeve 120 is present at a lower end of a movement region in the outer shell body 90, so that the movement of the head sleeve 120 can be regulated. The first claw 161 and the second claw 162 are arranged in a circumferential direction of the stopper sleeve 160, and formed to be tiltable inwardly in a radial direction of the stopper sleeve 160.

In the connection equipment 80 having such a configuration, in a state where the base 20A of the container connector 10A is inserted in the head sleeve 120 and pushed up into the outer shell body 90, the stopper sleeve 160 is fixed to the base 20A by engaging the claw 161 with the recess 23*b* of the base cap 23 as shown in FIG. 14.

Thus, the container connector 10A is fixed to the outer shell body 90 by the stopper sleeve 160. The fixing of the stopper sleeve 160 to the base 20A of the container connector 10A is released by lowering the container connector 10A downwardly. Specifically, when the container connector 10A is lowered, the protrusion formed on the inner surface of the outer shell body 90 presses the first claw 161, thereby rotating the first claw 161 in such a direction that the claw exits from the recess 23*b*.

As shown in FIG. 13, in a state where the base 20A of the container connector 10A is fixed to the head sleeve 120 via the stopper sleeve 160 and the container connector 10A is pushed up into the outer shell body 90, the needle 110 passes through the needle seal 130 and the seal 24 for the container connector with which the part La of the liquid flow path L1 and the part Lb of the gas flow path L2 are air-tightly sealed in the base 20A of the container connector 10A. Consequently, an interior of the container 5B communicates with an interior of the syringe 3 via the needle 110, and hence, the liquid flow path L1 via which the interior of the container 5B communicates with the interior of the syringe 3 is formed.

In a state where the base 20A of the container connector 10A is fixed to the head sleeve 120 and the container connector 10A is pushed up into the outer shell body 90, the seal 24 for the container connector in the base 20A lowers downwardly to unseal the opening 23*a* of the base 20A, and the needle seal 130 lowers downwardly to unseal the opening of the head sleeve 120. Consequently, the gas flow path Lb, the groove M and the gap G in the base 20A and the interior of the outer shell body 90 communicate with one another. Therefore, the gas flow path L2 through which the gas can flow is formed between the interior of the container 5B and the air bag 100.

In a state where the head sleeve 120 is disposed at the lower end of the movement region in the outer shell body 90, the lower end opening of the head sleeve 120 is sealed with the needle seal 130. Furthermore, an opening of a lower end of the needle 110 is stored in the needle seal 130 and sealed. Additionally, the second claw 162 of the stopper sleeve 160 engages with the protrusion in the outer shell body 90, whereby the head sleeve 120 is fixed to the outer shell body 90. When the container connector 10A is inserted in the head sleeve 120, the outer peripheral surface of the base cap 23 rotates the second claw 162 outwardly in a radial direction, and the second claw 162 accordingly rotates inwardly in an axial direction. By the rotation of the second claw 162, the second claw 162 and the protrusion of the inner surface of the outer shell body 90 are disengaged. Consequently, when the container connector 10A is inserted in the head sleeve 120, the head sleeve 120 can be pushed up into the outer shell body 90.

In the present embodiment, an effect similar to an effect of the first embodiment can be obtained. Note that the syringe connector 85 is not limited to a structure of the second embodiment. In short, the syringe connector 85 may be only configured to be connectable to the base 20A of the container connector 10A. As another example of the structure of the syringe connector 85, the syringe connector may have, for example, a hole in which the base 20A of the container connector 10A can fit. Furthermore, the syringe connector may include a fixing mechanism such as a claw to fix the container connector 10A in which the base 20A fits.

Note that in the first embodiment and the second embodiment, the swinging section constituting member 70 in which two swinging sections 50 are integrally formed is supported in the base 20 by one arm 60. However, it is not limited that the two swinging sections 50 are integrally formed. In another example, the swinging section constituting member 70 may be divided into two swinging sections 50. In this case, the one arm 60 is divided into two arm sections that are connected to the swinging sections 50, respectively. That is, the container connector 10 may have a configuration in which the swinging section constituting member 70 and the arm 60 are cut along the second virtual plane P2.

Furthermore, the inner surface 41 of the first guiding section 40A and the inner surface 41 of the second guiding section 40B are formed as curved surfaces. However, it is not limited that the inner surface 41 is the curved surface. In another example, the inner surface 41 may be formed as an inclined surface including a plurality of flat surface portions that can guide the container 5, 5A or 5B to the first engagement section 30A and the second engagement section 30B.

Each of the plurality of flat surface portions has an extension surface inclined to the first virtual plane P1. Furthermore, an inclination angle varies in accordance with the flat surface portion. Furthermore, as for the flat surface portion, the inclination angle of the extension surface to the first virtual plane P1 decreases as the flat surface portion is closer to the engagement section 30. That is, the inner surface 41 formed as the curved surface described in the first embodiment and the second embodiment may be approximated by the plurality of flat surface portions. In other words, the inner surface 41 formed of a plurality of inclined surfaces having inclination angles is configured so that the inclination angle to the axis decreases with closer proximity to the engagement section.

Furthermore, the container 5, 5A or 5B includes the neck 7, and the first engagement section 30A and the second engagement section 30B engage with the neck 7. However, in a case where the container does not include the neck 7 and is made of a comparatively soft material such as a resin, the first engagement section 30A and the second engagement section 30B can bite into an outer peripheral portion of the container to engage with the container.

Additionally, in the first embodiment and the second embodiment, the inner surface 41 of the guiding section 40A or 40B is formed as the curved surface having the tangent line inclined to the first virtual plane P1. In another example, the inner surface 41 may be formed as a curved surface having the tangent line S that passes along the axis C3 of the base 20. Furthermore, the inner surface 41 may be formed as a curved surface in which a tangent line of a region that comes in contact with the container 5 having an outer diameter presumed to be high in use frequency passes along the axis C3.

Furthermore, in the first embodiment and the second embodiment, the inner surface 41 of the guiding section 40 is formed in a three-dimensional shape. Consequently, the portion of the guide surface 41 on the one side end E1 side is formed in the shape that can guide the container 5 having the small diameter, and the portion of the guide surface on the other side end E2 side is formed in the shape that can guide the container 5 having the large diameter. Therefore, a position which guides the container 5 varies in accordance with the bore diameter of the container. Furthermore, a portion that comes in contact with the container 5 is formed as a curved surface having a curvature suitable for the container 5 so that the container can be smoothly guided to the engagement section 30.

Additionally, the inner surface 41 is formed as the curved surface suitable for the container 5 having a different bore diameter in the whole region of the inner surface, but the present invention is not limited to this example. In another example, the inner surface 41 may have, for example, a portion on the one side end E1 side formed as a curved surface suitable for the container 5 having a small bore diameter, and a portion on the other side end E2 side formed as a curved surface suitable for the container 5 having a large bore diameter, and a portion between these curved surfaces may be formed as a flat surface. That is, the inner surface 41 may be formed as a surface that can smoothly guide the container 5 having the small bore diameter and the container 5 having the large bore diameter.

Note that as in the first embodiment and the second embodiment, the whole region of the inner surface 41 is formed as the curved surface, so that the container 5 including a shoulder portion having an outer diameter larger than an outer diameter of the opening end portion 9 can avoid contact of the shoulder portion with the inner surface 41.

Note that the first virtual plane P1 and the second virtual plane P2 are the planes that pass along the axis of the base 20 in the first embodiment, and are the planes that pass along the axis of the base main body 22 and the axis of the needle 25 in the second embodiment. That is, in the first embodiment and the second embodiment, the circle X is a circle about the axis of the base 20 or 20A. However, it is not limited that the circle X is the circle that passes along the axis of the base. For example, in a case where the base has a complicated shape and the axis is not a straight line, a center of any cross section (the cross section orthogonal to the axis) of the base 20 may be set to the center of the circle. As for the circle X, the position of the center of the circle is set so that the container 5 can be smoothly guided to the engagement section 30. In a case where the base is cylindrical or an appearance is columnar as in the first embodiment and the second embodiment, it is preferable that the axis is set to the center of the circle X.

Note that the present invention is not limited to the above embodiment, and can be variously deformed in an implementation stage without departing from the scope. Additionally, the respective embodiments may be appropriately combined and implemented, and in this case, combined effects can be obtained. Furthermore, the above embodiments include various inventions, and various inventions can be extracted by selected combinations from a plurality of disclosed components. For example, even when several components are eliminated from all components described in the embodiments, problems can be solved and effects can be obtained. In this case, a configuration from which the components are eliminated can be extracted as the invention.

Additional advantages and modification will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A container connector that is connectable to a container, comprising:

a base in which a flow path is formed;

an engagement section disposed on a virtual circle set to the base;

a guiding section disposed continuously with the engagement section, and having a guide surface formed as a curved surface to guide the container to the engagement section and facing a side of an axis of the virtual circle; and an arm provided on the base, and movably supporting the guiding section in a direction toward the axis of the virtual circle and a direction away from the axis of the virtual circle;

wherein:

the arm is one of a pair of arms included with the container connector and each arranged symmetrically to a first virtual plane that passes along the axis of the virtual circle and is parallel to the axis of the virtual circle;

the guiding section extends from the engagement section in an axial direction of the virtual circle; and the guide surface is formed as the curved surface including a tangent line having an inclination angle relative to the first virtual plane, the inclination angle decreases with closer proximity to the engagement section from an end portion of the guide surface on a side opposite to the engagement section in the axial direction;

wherein:

a pair of guiding sections and a pair of engagement sections are provided on each one of the pair of arms symmetrically to a second virtual plane that passes along the axis of the virtual circle and is orthogonal to the first virtual plane;

wherein:

each one of the pair of guiding sections provided in each one of the pair of arms are continuously formed;

the axis of the virtual circle has a vertical direction and in a cross section of each one of the pair of guiding sections in a horizontal direction to the axis of the virtual circle, one side end of each one of the pair of guide surfaces on a side of the second virtual plane is located at a position away from the first virtual plane that passes through the axis of the virtual circle relative to another side end of the pair of guide surfaces on a side opposite to the second virtual plane, in a direction orthogonal to the axis of the virtual circle and parallel to the second virtual plane;

the one side end of each one of the pair of guide surfaces is formed as a straight line or a curved line; and each one of the pair of guide surfaces is formed as the curved surface so that a radius of curvature decreases from a side of the one side end toward a side of the other side end.

2. The container connector according to claim 1, wherein the one side end of the guide surface is formed as a straight line, the guide surface is inclined at multiple inclination angles each defined by a tangent line of a respective portion of the guide surface with respect to the first virtual plane, the multiple inclination angles include a first inclination angle for a portion of the other side end of the guide surface which is adjacent the engagement section, the first inclination angle being smaller than an extension inclination angle defined by an extension of the one side end of the guide surface with respect to the first virtual plane, and the multiple inclination angles further include a second inclination angle for a portion of the other side end of the guide surface which is opposite to the engagement section, the second inclination angle being larger than the extension inclination angle.

3. The container connector according to claim 1, wherein the arm comprises:

a first extending portion extending from the base to a side opposite to the guiding section in an axial direction of the virtual circle, and a second extending portion folded from the first extending portion, which is upwardly-extending, the second extending portion then extends downward towards the guiding section.

4. Connection equipment comprising:

the container connector according to claim 1, and a syringe connector adapted to be attached to and detached from the base of the container connector, and including a flow path for the syringe connector which communicates with the flow path of the base in a state of being attached to the base.

* * * * *